US007039301B1

(12) United States Patent
Aisenberg et al.

(10) Patent No.: US 7,039,301 B1
(45) Date of Patent: May 2, 2006

(54) METHOD AND APPARATUS FOR HAND DRYING

(75) Inventors: Sol Aisenberg, Natick, MA (US); George Freedman, Wayland, MA (US); A. Ze'ev Hed, Nashua, NH (US); Richard Pavelle, Lexington, MA (US)

(73) Assignee: Excel Dryer, Inc., East Longmeadow, MA (US)

( * ) Notice: Subject to any disclaimer, the term of this patent is extended or adjusted under 35 U.S.C. 154(b) by 71 days.

(21) Appl. No.: 09/679,096

(22) Filed: Oct. 4, 2000

Related U.S. Application Data

(60) Provisional application No. 60/157,495, filed on Oct. 4, 1999.

(51) Int. Cl.
*F24H 3/00* (2006.01)
*A47K 10/48* (2006.01)

(52) U.S. Cl. ..... 392/380; 34/201; 392/379

(58) Field of Classification Search ..... 392/380–383, 392/384, 385, 379; 34/96, 97, 202, 201
See application file for complete search history.

(56) References Cited

U.S. PATENT DOCUMENTS

| | | | | | |
|---|---|---|---|---|---|
| 1,455,034 | A | * | 5/1923 | Small | 392/383 |
| 1,707,554 | A | * | 2/1929 | Hendry | 34/96 |
| 1,781,542 | A | * | 11/1930 | Engberg et al. | 392/384 |
| 2,392,405 | A | | 1/1946 | Phipps | |
| 2,464,552 | A | * | 3/1949 | Breuer | 392/384 |
| 2,478,559 | A | * | 8/1949 | Bergeron | 392/383 |
| 2,512,769 | A | | 6/1950 | Crumrine | |
| 2,651,705 | A | | 9/1953 | Clemens | |
| 3,128,161 | A | | 4/1964 | Hudon | |
| 3,305,938 | A | * | 2/1967 | Goldstein | 34/202 |
| 3,612,824 | A | * | 10/1971 | Berryman et al. | 392/383 |
| 3,621,199 | A | | 11/1971 | Goldstein | |
| 3,643,346 | A | | 2/1972 | Lester | |
| 3,674,980 | A | | 7/1972 | Cox | |
| 3,766,397 | A | | 10/1973 | Rockson | |
| 3,902,508 | A | | 9/1975 | Sliman, Sr. | |
| 4,087,924 | A | | 5/1978 | Fujimoro et al. | |
| 4,197,448 | A | | 4/1980 | Harigai | |
| 4,226,251 | A | | 10/1980 | Wall | |
| 4,263,500 | A | | 4/1981 | Springer et al. | |

(Continued)

FOREIGN PATENT DOCUMENTS

| | | | |
|---|---|---|---|
| DE | 292572 | * | 6/1916 |
| DE | 1076222 | * | 2/1960 |
| EP | 170974 | * | 2/1986 |
| EP | 400381 | * | 12/1990 |
| GB | 2270838 | * | 3/1994 |
| JP | 4-367609 | * | 12/1992 |

(Continued)

OTHER PUBLICATIONS

Fastaire Hand Dryers, Hand Dryers, Apr. 1, 1997, pp. 1–6.
Exair Corporation, 1995, Exair–Knife, Section 8, pp. 35–42.
Web Systems, Inc., The Chinook Ultra–Dryer 4 pgs. (Apr. 1997).

*Primary Examiner*—John A. Jeffery
(74) *Attorney, Agent, or Firm*—Cantor Colburn LLP

(57) ABSTRACT

After washing, the hands are dried rapidly and comfortably by using a shaped high speed flow of heated air. The air flows in a direction controlled by an air outlet shaped to retain much of the exiting forceful air flow and temperature at a distance where the hands are dried. The air entrainment is controlled so that the properties of the air flow are not diluted by the air entrainment to a point where the drying performance is degraded. The forceful air flow blows off most of the loose water on the hands. The forceful air flow also reduces the stagnation boundary layers in the hands so that the evaporation removal of the remaining film of water is improved. These result in reduced drying time and comfort during and after drying.

7 Claims, 14 Drawing Sheets

U.S. PATENT DOCUMENTS

| | | | | | |
|---|---|---|---|---|---|
| 4,323,761 | A | | 4/1982 | Hubner | |
| 4,327,278 | A | * | 4/1982 | Tomaro | 392/385 |
| 4,349,725 | A | * | 9/1982 | Sheridan | 392/383 |
| 4,419,835 | A | | 12/1983 | Strain | |
| 4,461,439 | A | * | 7/1984 | Rose | 392/385 |
| 4,464,906 | A | | 8/1984 | Outlaw | |
| 4,536,198 | A | | 8/1985 | Strain | |
| 4,596,921 | A | * | 6/1986 | Hersh et al. | 392/385 |
| 4,634,839 | A | * | 1/1987 | Gilbertson | 392/383 |
| 4,659,907 | A | * | 4/1987 | Andis et al. | 392/384 |
| 4,746,090 | A | * | 5/1988 | Hamilton | 392/385 |
| 4,754,769 | A | | 7/1988 | Flynn | |
| 4,794,225 | A | * | 12/1988 | Maese | 392/385 |
| H677 | H | * | 9/1989 | Lambright | 310/68 C |
| 4,876,435 | A | | 10/1989 | Hawkins | |
| 4,914,273 | A | | 4/1990 | Matsui | |
| 4,991,314 | A | | 2/1991 | Allen | |
| 5,054,211 | A | * | 10/1991 | Shulman | 34/97 |
| 5,163,234 | A | | 11/1992 | Tsukamoto et al. | |
| 5,269,071 | A | | 12/1993 | Hamabe et al. | |
| 5,282,364 | A | | 2/1994 | Cech | |
| 5,331,747 | A | | 7/1994 | Stanton | |
| 5,394,620 | A | * | 3/1995 | Chimera | 34/97 |
| 5,458,458 | A | | 10/1995 | Tada et al. | |
| 5,459,944 | A | | 10/1995 | Tatsutani et al. | |
| 5,507,103 | A | | 4/1996 | Merritt | |
| 5,526,578 | A | * | 6/1996 | Iyer | 34/97 |
| 5,555,637 | A | * | 9/1996 | Montagnino | 34/97 |
| 5,599,229 | A | | 2/1997 | Claunch et al. | |
| 5,668,921 | A | | 9/1997 | Essler | |
| 5,841,943 | A | * | 11/1998 | Nosenchuck | 392/385 |
| 6,094,837 | A | * | 8/2000 | Cantor | 34/97 |

FOREIGN PATENT DOCUMENTS

| | | | |
|---|---|---|---|
| JP | 5-91755 | * | 4/1993 |
| JP | 5-130915 | * | 5/1993 |
| JP | 2000-175839 | * | 6/2000 |
| WO | 8302753 | * | 8/1983 |
| WO | 9423611 | * | 10/1994 |

* cited by examiner

METHOD AND APPARATUS FOR HAND DRYING

CROSS REFERENCE TO RELATED APPLICATIONS

This application claims the benefit of U.S. provisional patent application Ser. No. 60/157,495 filed Oct. 4, 1999, the entire contents of which are incorporated herein by reference.

BACKGROUND OF THE INVENTION

1. Field of the Invention

The present invention relates to drying devices, and more particularly to a drying device adapted for improved and faster and more comfortable drying of a user's hands and/or hair.

2. Description of the Related Art

Conventional hand dryers dry an individual's wet hands in one of two ways, evaporative drying or "blow-off" drying. (In the blow-off case, a small amount of evaporation occurs, but it is incidental and minimal since the airstream is not warmed.) Conventional evaporative hand dryers include a blower for generating an air stream through a ducting system to an exit air outlet that directs the air stream onto the hands of the user. The air stream is heated by a heating device to evaporate the moisture off the user's hands. The hand dryers generally include a push button, sensor or other means to actuate the blower and heater for a predetermined time period (e.g., 30 seconds).

The drying time for conventional evaporative hand dryers is relatively slow, taking 30 to 45 seconds or more to dry a user's hands. Conventional dryers suffer from low energy efficiency. The low energy efficiency is a result of the following operating factors: heating up the internal dryer components; not maximizing and optimizing air flow temperature, direction and velocity; not compensating locally for evaporative cooling; and not addressing the problem of a stagnation boundary layer of air and water molecules which inhibits evaporation of water at the skin surface of the hands. Attempts to improve energy efficiency in the prior art include providing an enclosure for the hands, recirculating air and predrying the air.

A major impediment to evaporation is the presence of a stagnation boundary layer, which is a region adjacent to the surface of the water. The stagnation boundary layer corresponds to the transition region from where air containing evaporated water molecules are moving and where water molecules adjacent to the water surface (or any other surface) are not moving or moving much slower. In this stagnation boundary layer, the water molecules evaporating will accumulate, and about as many will flow back to the water surface as will flow away into the flowing stream of air. This stagnation boundary layer inhibits the net evaporation of surface water. By breaking up the stagnation boundary layer with a strong component of air flow perpendicular to the surface, the evaporation is increased. Rather than accumulating in the stagnation boundary layer and inhibiting the net evaporation of water, the water molecules in the stagnation boundary layer are swept away, as fast as they accumulate, by the air breaking up the stagnation boundary layer. U.S. Pat. No. 6,038,786, the entire contents of which are incorporated herein by reference, discloses a hand dryer that improves dispersion of the boundary layer.

To diffuse the stagnation boundary layer, a second type of conventional hand dryers uses "blow-off" or "air knife" technology instead of evaporation (although a small amount of evaporation occurs). These blow-off dyers provide an intensive blast of high velocity air which when suitably deployed, blows or skives droplets of water off the user's hands.

It has been found that after using a conventional "blow-off" hand dryer, the hands feel cold and slightly moist, as a result of the heat loss and subsequent cooling due to evaporation of some of the residual moisture that has not been blown off. The hands are cooled during blow off drying because even air that has not been heated will evaporate some water, and the remaining water and surface will thus be cooled by the heat loss due to evaporation. This discomfort is present during drying and for about 30 seconds after drying until the hands return to normal temperature.

SUMMARY OF THE INVENTION

The above-discussed and other drawbacks and deficiencies of the prior art are overcome or alleviated by the dryer of the present invention. An exemplary embodiment of the invention is a dryer, which uses an optimized air outlet to generate both optimal force and temperature at the user's hands. The air outlet is sized and shaped to entrain a sufficient amount of air so as to increase force of the airstream while not entraining too much air, which would otherwise significantly reduce the airstream temperature. Additionally, the air outlet design allows for control of the width of the warm air zone within the airstream. This optimized air outlet provides reduced drying time and in-process comfort and results in improved dryer performance and comfort. The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE INVENTION

An exemplary embodiment of the invention is a dryer that provides decreased drying time and also provides the user with a high degree of comfort. Comfort is a feeling of warmth, both during and after the drying process has been concluded, and a sufficient level of dryness after the drying process has concluded. In the experiments performed related to the invention, dryness was considered attained when the residual water on the hands (or other surface) is 0.20 grams or less. This is based on the subjective feelings of comfort from a number of subjects, followed by measurement of the weight of water remaining on the hands of the subjects. The residual water was measured using a process that takes into account variations in hand size, hand movements during drying, soaping, and ambient temperature and humidity. This is a higher comfort standard than currently accepted in the industry. In today's practice, conventional evaporative dryers remove about 90% of the baseline water so that on average, after a 30 second drying cycle, about 0.40–0.50 grams of residual water remains on the hands. In addition to enhanced comfort due to less residual water, the invention provides "in-process comfort" which is a feeling of warmth during the drying cycle. Such comfort normally correlates to a residual water amount of 0.20 grams or less.

Figure 1:
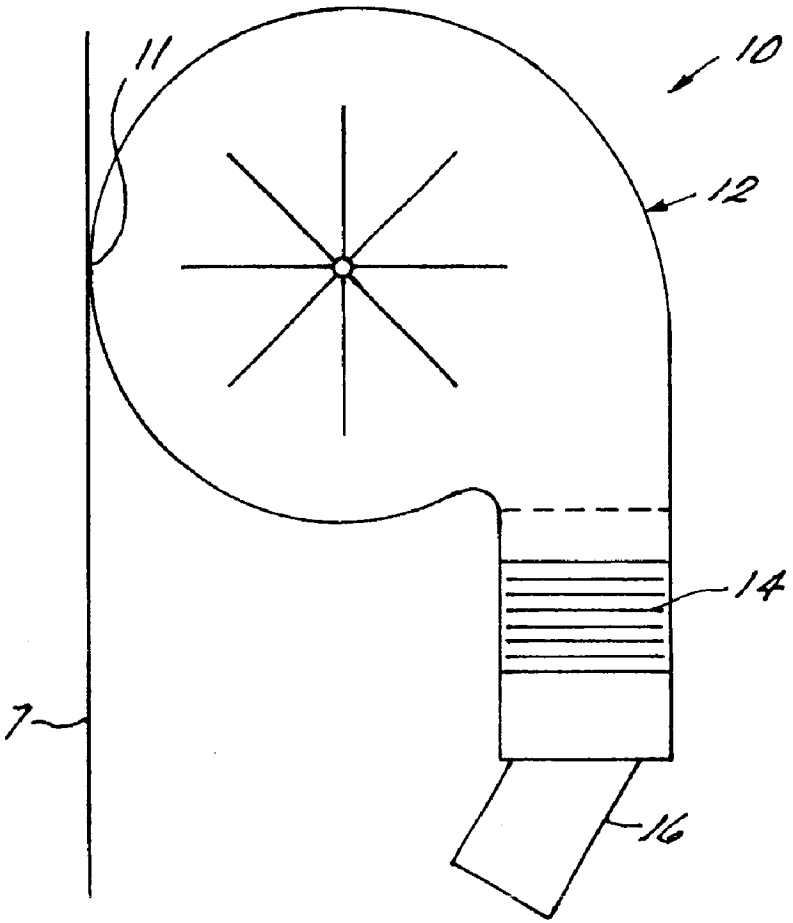
FIG. 1 depicts a dryer in an exemplary embodiment of the invention.

FIG. 1 is a diagrammatic view of a hand dryer 10 in an exemplary embodiment of the invention. The hand dryer 10 includes three major components including a blower 12, a heater 14 and an air outlet 16. Additional components, such as a control device for initiating the drying cycle and stopping the dryer, may be included as known in the art. The blower 12 may be a fan-type blower, vacuum cleaner blower or a multistage blower for larger output pressure which directs air through the following heater 14 and out through air outlet 16. The heater may be any known type of heater including a wire wound heater which generates heat through resistive elements and/or an infra-red heater. The blower 12 and the air outlet 16 are selected so as to provide optimum drying as described herein. As described in further detail herein, the volume output of blower 12 and the size and shape of air outlet 16 are selected so as to provide both blow-off drying and evaporation drying.

Figure 2:
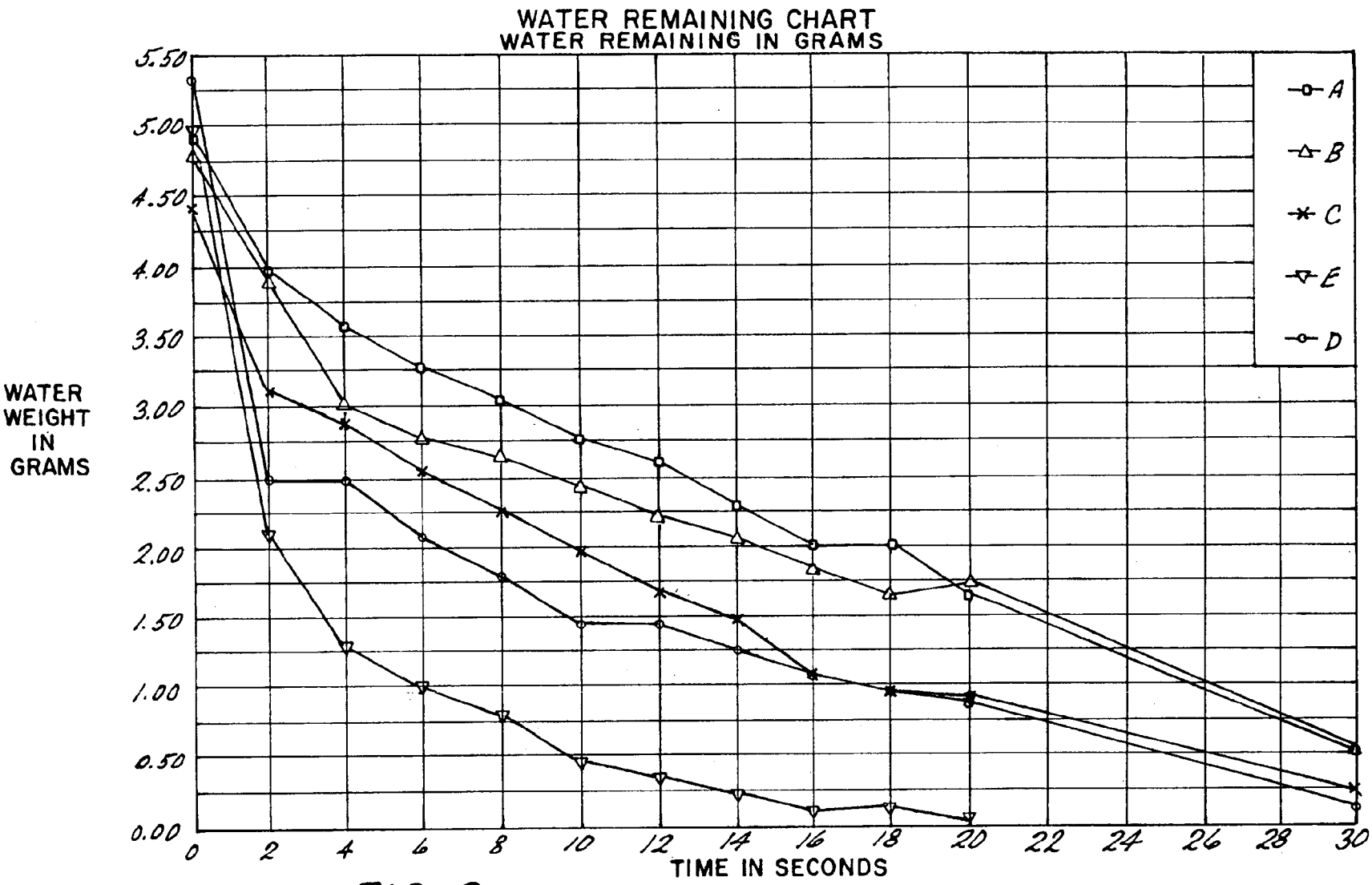
FIG. 2 is a graph of residual water versus time.

FIG. 2 is graph of time versus residual water for three conventional evaporation dryers shown as A–C, a conventional blow-off dryer shown as D and an embodiment of the present invention shown as E. As shown in FIG. 2, to obtain a comfort level of approximately 0.20 grams of residual water, current dryers A–C require approximately 30–45 seconds to achieve a satisfactory level of dryness. For the typical user, this is simply too long. Experiments have shown that the exemplary embodiment of the invention (shown as curve E) achieves the 0.20 grams of residual water comfort level in approximately 13 seconds.

The exemplary embodiment of the invention achieves reduced drying time and comfort by incorporating an optimum combination of both blow-off and evaporative drying. This can be noted in FIG. 2, in plot E, which shows two modes of water removal involving first blow-off of loose water, followed by some evaporation. The blow-off takes place in about the first 2–3 seconds with a very steep slope of decline in moisture on the hands, when about three quarters of the moisture—the loose droplets—are removed. For example, the average water load on recently washed hands of average size is about 6 grams. It has been observed that on the average about 4.5 grams or about 75% of this is loose water, which is easily blown off using this invention. This leaves about 1.5 grams of water which is adherent to the hands and is designated as residual water. The evaporation phase occurs in the time from about 2–3 seconds to about 12–14 seconds. During this time, some blow-off drying also occurs. This phase has a slope of less steepness and corresponds to blowing off the last loose droplets combined with the evaporation. A dryness level of about 0.20 grams of residual water is achieved in 12–14 seconds. To obtain rapid drying time and comfort, an exemplary embodiment of the invention optimizes the force and temperature of the airstream to provide blow-off and evaporative drying. The forceful airflow is also used to break up the stagnation layer of the residual water film on the hands, and this aids in faster water evaporation. The impact force required for this is much more than is used in conventional evaporation dryers but less than that required for blow off of loose water.

It is possible to program the motor speed electronically during the dryer cycle and thus minimize the time span of the blow-off phase. Since the most forceful air stream is required only during the first 2–3 seconds, motor speed can be throttled down, after the blow off phase, to just enough to break up the stagnation layer after that period without affecting drying efficiency. This will result in a quieter evaporation phase. An additional advantage is that more electrical power can be made available during the evaporation phase to speed evaporation.

Control of the motor speed, and numerous other functions, may be performed through a single control card containing multiple solid state circuits that work together as a single control system, thus eliminating redundant circuit elements. In addition, the control card may implement supplemental functions such as providing a proximity sensor capability for detecting the presence of the hands in the drying location, etc. Advantages of this multi-function control card include a small size, which allows more physical room inside the dryer housing for the motor and for additional insulation, etc. than is conventional. Another advantage is the capability for controlling functions far more complex than are available in conventional dryer control circuits. Lastly, a single control card provides significantly decreased cost compared to individual controls that do not work together as a single control system.

Figure 3:
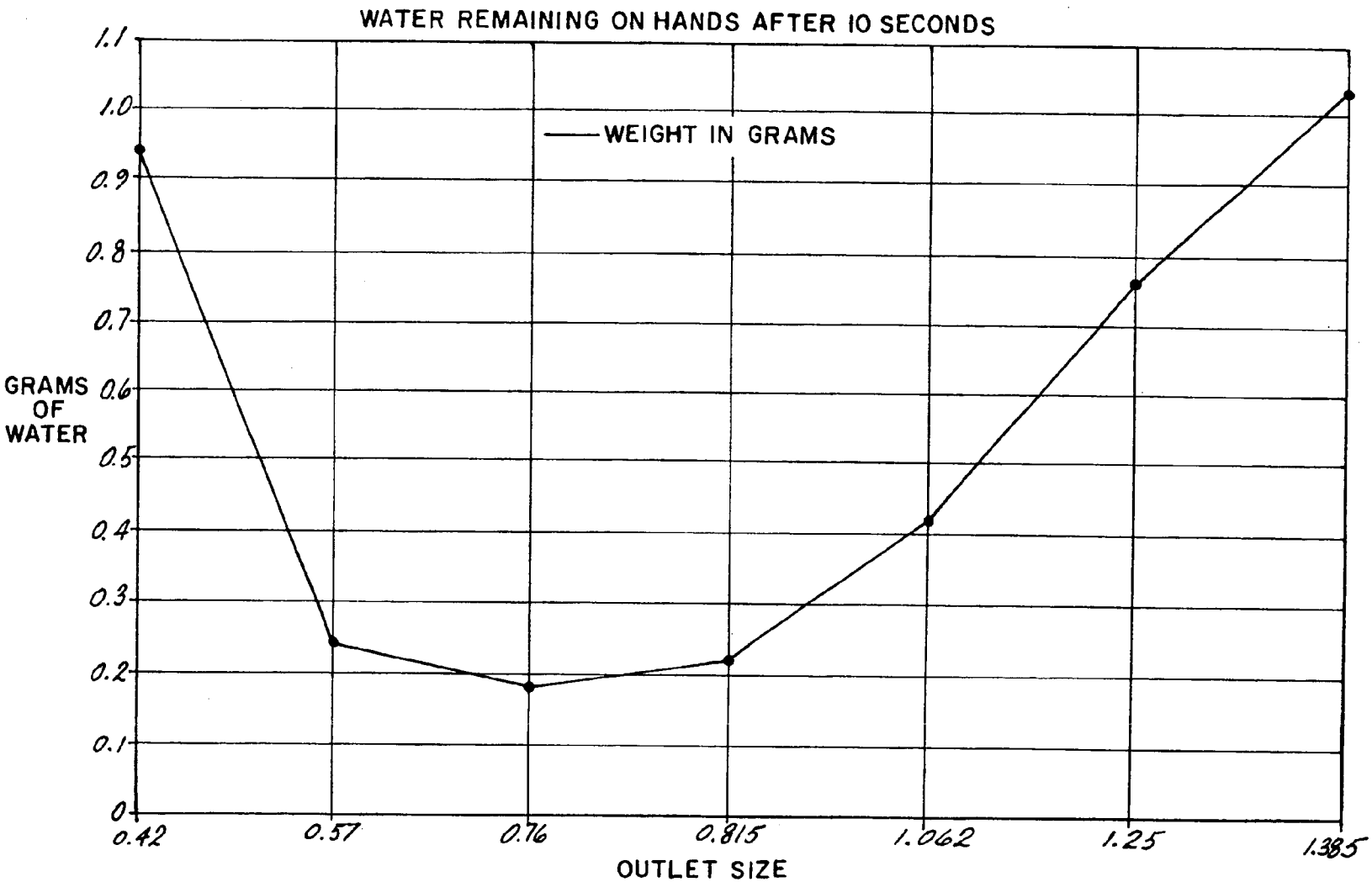
FIG. 3 is a graph of residual water versus outlet size.

To obtain high force and high temperature in the air stream exiting the air outlet 16, entrainment of the air stream is managed. Entrainment is the phenomenon of outside air being drawn into the air stream through a Venturi effect. As the speed of an airstream increases, entrainment increases. Entrained air increases blow-off performance because the entrained air increases the mass and momentum force of the air stream and thus provides more force to the drying surface. For a given airstream speed, entrainment further increases with decreasing air outlet opening. This is because relatively more of the airstream is in contact with the outside air because the ratio of perimeter (where entrainment occurs) to cross sectional area increases. As shown in FIG. 3, for outlets of circular cross section, the most rapid drying occurs for the circular outlets having diameters of 0.57", 0.76" and 0.815". For these outlet circle diameters, the ratios of perimeter to area are 6.9, 5.3, and 4.9 respectively, in units of reciprocal inches. These values are calculated as shown in the following formula $$P/A=(2*Pi*r)/(Pi*r*r)$$

where Pi=3.14159.

The P/A ratio has an effect on the drying time. In FIG. 3, the P/A ratio varies from 2.8 to 9.6 for circular outlets ranging from 1.385" to 0.42". The most rapid drying occurs in circular outlets having a P/A ratio ranging from 5.0 to 6.7. Conventional evaporative dryers with non-circular outlets as wide as 4" typically have P/A ratios as low as 1.0. On the other extreme, a conventional blow-off dryer uses air jets having a 0.03" diameter which corresponds to a P/A ratio of 132. Using outlets of this size, the entrained air can be as much as 25 times the primary air resulting in the phenomenon of "air amplification." Makers of air knives, which skim liquids from surfaces with extraordinary speed, also use rows of such jets for this purpose. When the air entrainment is very large, the average temperature of the warm exiting air decreases rapidly, when mixed with large quantities of room air, which results in reduced evaporation rate.

It is clear from this empirical data that when the perimeter to area ratio is in a range from about 5 to about 7, the fastest drying occurs. Nevertheless, a tradeoff must be made between drying time and user comfort. Smaller diameter outlets result in higher force of the airstream which may lead to user discomfort. Outlets having a P/A range of about 2.5 to about 7 have provided satisfactory results.

While entrainment of cool room air can increase air stream force, it also reduces the airstream temperature. Accordingly, to perform more effective evaporation and to provide the user with in-process comfort (i.e., warm hands during and immediately after drying) it is important not to entrain too much air. Entraining air causes a reduction of temperature of the heated air that is used for the later stages of hand drying which involves evaporation of water films that cannot be readily blown off. Thus, the entrained air is concentrated in an outer sheath of the air stream so that the temperature of the core region of that air stream is only minimally affected by the lower temperature of the air in that outer sheath.

Circular air outlets provide an advantage over other outlet shapes because they give the lowest P/A ratios for the largest enclosed areas because the perimeter of a circle encloses the greatest area of any geometrical figure. This means that the core region of the air stream is thicker and the sheath region (holding lower temperature air) is thinner than for any other outlet shape. This makes it harder for the temperature of the core region of the air stream to be degraded by the lower temperature entrained air in the sheath than for any other outlet shape. Air outlet shapes of other forms such as ellipses, slots, etc., will also provide satisfactory results, but, depending on the degree of deviation from the circular, may exceed the desired range of P/A ratios—under which condition they will work poorly. This is also the case for multiple airstreams from the same blower source.

Figure 4:
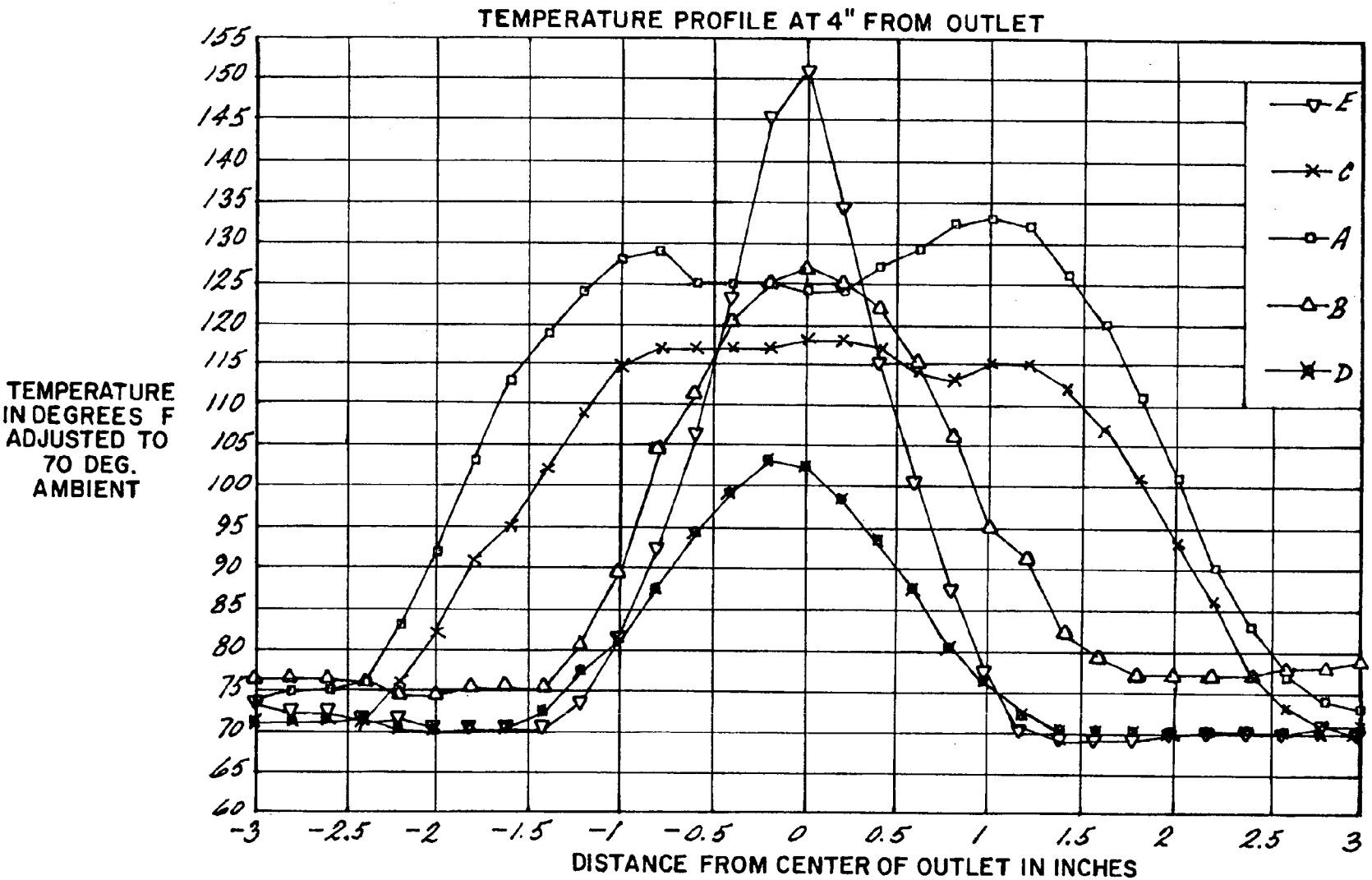
FIG. 4 is a graph of airstream temperature versus distance from the center of the air outlet.

FIG. 4 is a graph of air temperature measured at various locations along diameters in the cross section of the airstream four inches from the air outlet. Plot E corresponds to an exemplary embodiment of the invention having a circular air outlet of 1.062" diameter. As described herein, the air outlet 16 may have a variety of geometries and is not limited to circular. Plots A–C correspond to conventional evaporation dyers and plot D corresponds to a conventional blow-off dryer. FIG. 4 shows that the exemplary embodiment of the invention in plot E has a higher temperature four inches from the outlet than any of the conventional dryers tested.

Figure 5:
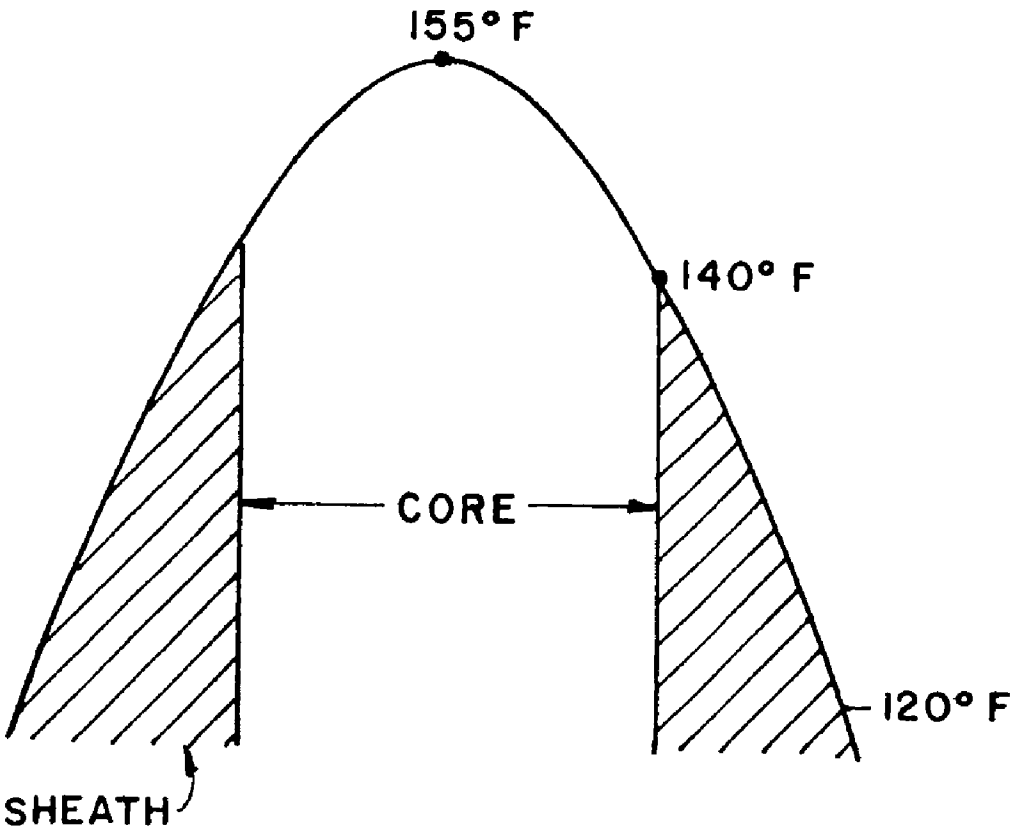
FIG. 5 depicts the core and sheath effect across the diameter of a high force airstream in terms of temperature distribution.

FIG. 5 illustrates the drop off in temperature as measured from the center of the airstream (referred to as the core) to the periphery of the airstream (referred to as the sheath). The smaller the diameter of the air outlet, the steeper the temperature decrease from core to sheath. This is due to the fact that small outlets (having high P/A ratios) produce more forceful airstreams for the same amount of air transmitted through the outlet than larger outlets (see FIG. 7). This makes it difficult for the entrained room temperature air to penetrate into the core from the sheath and lower its temperature.

The amount of the entrained air within the cross section of the air stream is controlled to provide comfort and reduced drying time. For the outlet shown in plot E of FIG. 4, the outer sheath of the airstream is cooled due to entrainment, but the inner core remains a warm jet, thus maximizing evaporation when the airstream contacts the hands. Drying is enhanced when the core temperature is maintained all the way down to the hands so that the evaporation remains effective. Maintaining core temperature is a direct result of selecting the right P/A ratio for the air outlet. When the diameter of the outlet is too large or too small the required higher evaporation temperature is not achieved. Additionally, the P/A ratio should be selected to optimize the impact force of the airstream on the hands for effective blow-off drying.

Referring to FIG. 4, plots A–C correspond to conventional evaporation dryers which have large air outlets with P/A ratios between 1.0 and 2.0. Accordingly, the amount of entrained air is small compared to the size of the air stream resulting in less temperature differential between the core and sheath. FIG. 4 illustrates that the exemplary embodiment of the invention in plot E generates a sheath of cooler air around a warmer core as a result of entrainment. The conventional evaporative dryers in plots A–C have little sheath/core effect and the temperature of the airstream is reduced through dilution of the airstream with the cooler room air.

Figure 6:
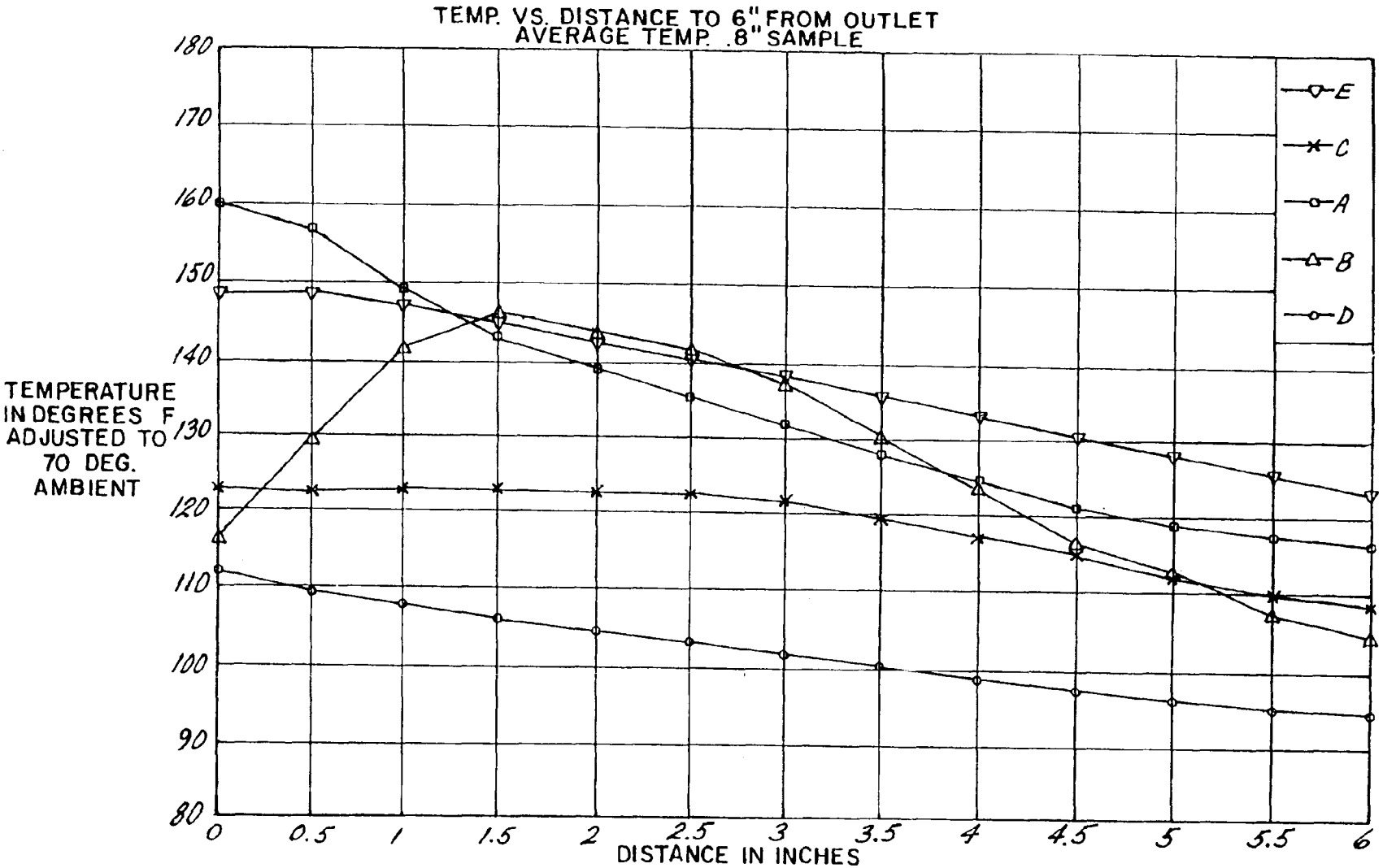
FIG. 6 is a graph of airstream temperature versus distance.

An exemplary embodiment of the invention has been tested against conventional hand dryers for both airstream temperature and airstream force. FIG. 6 is a graph of average airstream temperature versus distance for conventional evaporation dryers shown as plots A–C, a conventional blow-off dryer shown as plot D and an exemplary embodiment of the invention using a circular air outlet having a diameter of 1.062 inches shown in plot E. As shown in FIG. 6, the exemplary embodiment of the invention provides an air stream having a high average air stream temperature 4" to 6" from the air outlet where most people position their hands. The conventional dryers in plot A–C have lower air stream temperatures 4" to 6" from the air outlet. An embodiment of the invention uses a tubular air outlet that tends to reduce the transverse motion of the exiting air so that the exiting air remains in a tight flow pattern while moving toward the hands. The tubular air outlet should have a length (along the axis of the airstream) greater than the largest dimension of the air outlet transverse to the airstream. An exemplary air outlet length is about 3 to about 5 times the diameter of the air stream passing through the air outlet. With respect to the blow-off dryer in plot D, there is no internal heater, thus the air stream is not significantly warmed. Some warming does occur due to the heat generated by the blower motor used in the blow-off dryer.

Figure 7:
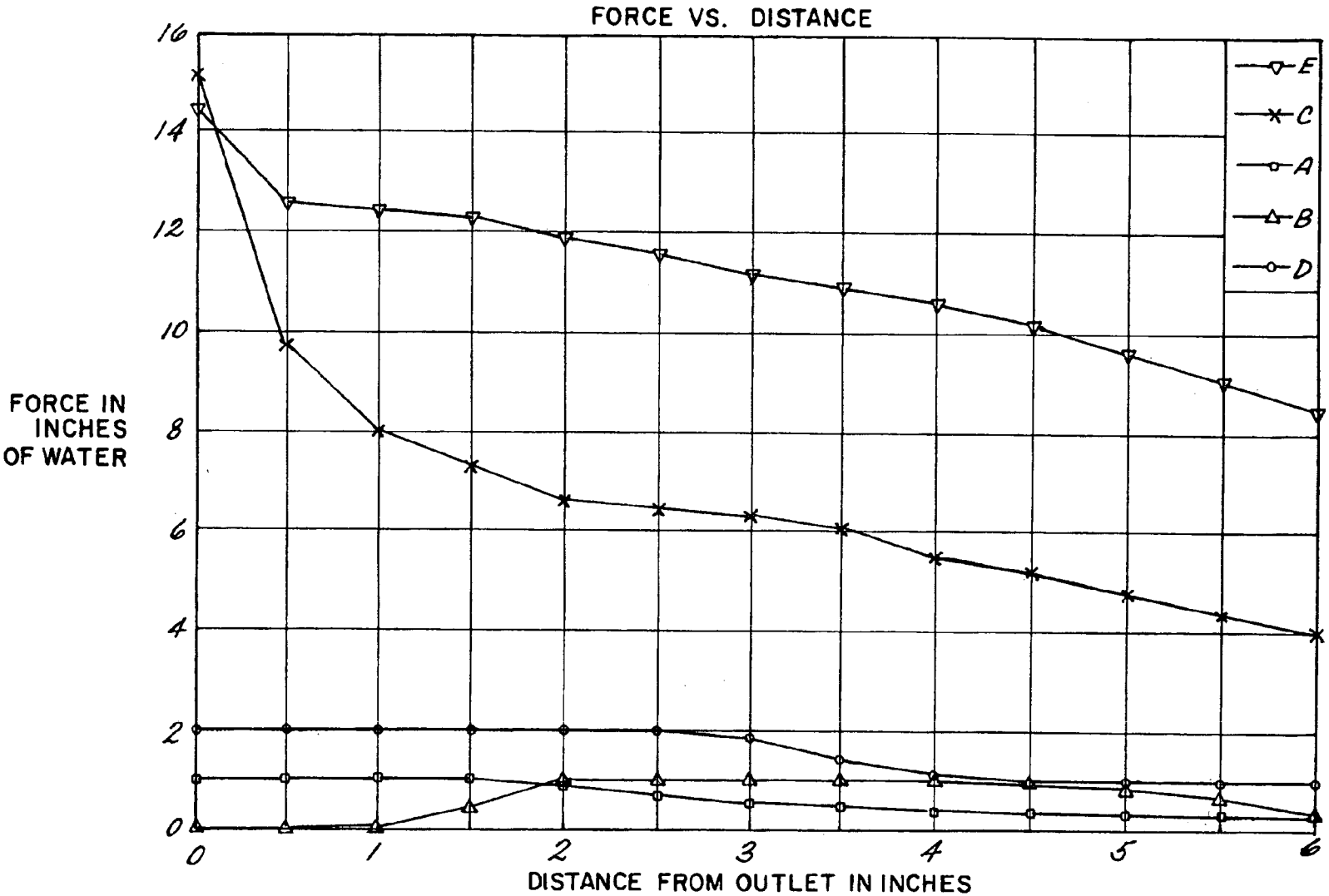
FIG. 7 is graph of airstream force versus distance.

FIG. 7 is a graph of airstream force versus distance for conventional evaporation dryers shown as plots A–C, a conventional blow-off dryer shown as plot D and an embodiment of the invention shown in plot E using a circular air outlet having a diameter of 1.062 inches. The force was measured using a water column and the measure of force is expressed in inches of water. As shown in FIG. 7, the exemplary embodiment of the invention provides substantially more force at all distances from the outlet when compared to the evaporation dryers shown in plots A–C. The exemplary embodiment of the invention also provides more force than the conventional blow-off dryer in plot D for distances greater than 0.5 inches from the air outlet. FIGS. 6 and 7 depict that the exemplary embodiment of the invention provides higher force and higher temperature 4 to 6 inches from the air outlet than conventional dryers.

Plots A–C in FIG. 7 depict a reason for the long drying time of conventional evaporation dryers. The stagnation boundary layer of moisture at the skin surface, which inhibits evaporation, is allowed to persist through the drying cycle because the airstream is gentle and impacts on the hands with minimal force. By contrast, the exemplary embodiment of the invention shown in plot E generates an airstream that contacts the hands at least ten times harder at the four-inch distance. The enhanced force of the airstream of the exemplary embodiment of the invention is a result of entraining air into the airstream sheath due to the optimum P/A value. The conventional blow-off dryer shown in plot D has an initially strong force that diminishes rapidly as measured from the air outlet. The fact that the exemplary embodiment uses a more powerful blower motor than is used in conventional dryers enhances this effect, both because it generates a more forceful air stream to begin with and because, being more powerful, entrains more air.

Figure 8:
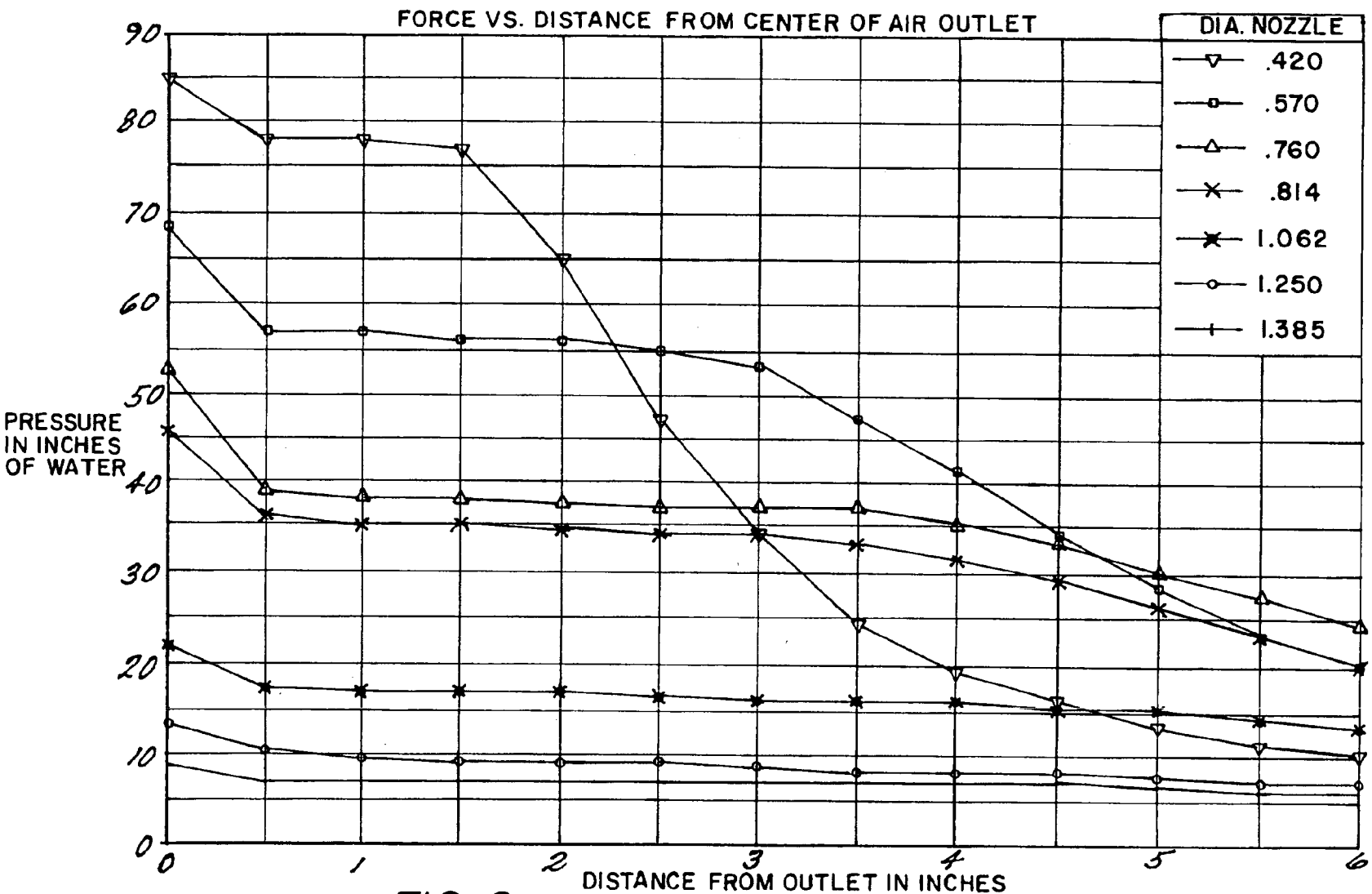
FIG. 8 is a graph of airstream force versus distance for different outlet sizes.
Figure 9:
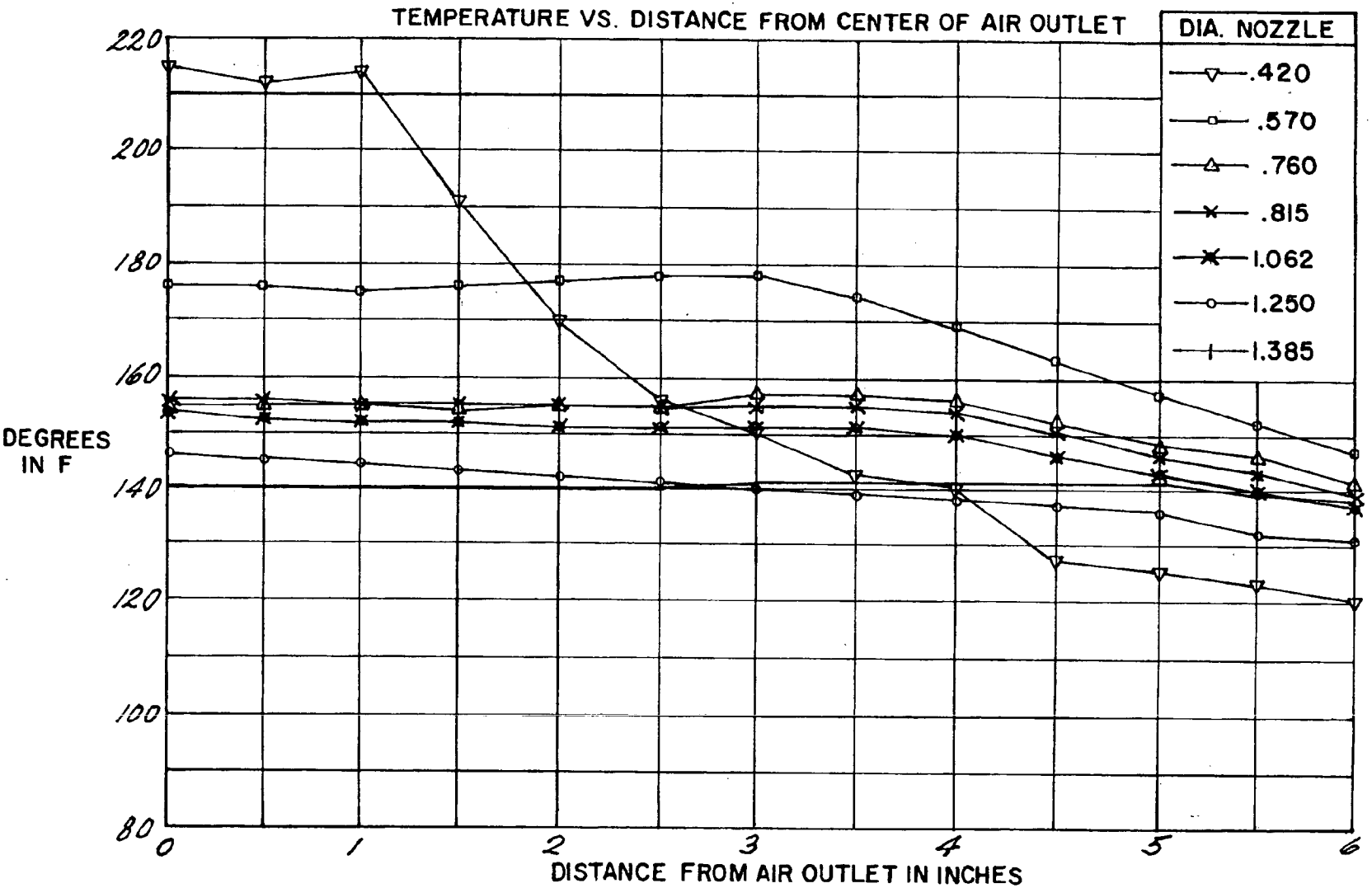
FIG. 9 is a graph of airstream temperature versus distance for different outlet sizes.

Experiments have been performed with a variety of air outlet shapes and sizes to determine the effect of the air outlet on drying. FIG. 8 is a graph of force versus distance from the center of the air outlet for a variety of circular air outlets in exemplary embodiments of the invention. The pressure was measured using a water column and pressure is represented as inches of water. FIG. 9 is a graph of temperature versus distance from the center of the air outlet for a variety of air outlets in exemplary embodiments of the invention. Note that for the smallest air outlet, outlet temperature is highest at 215 degrees, but this quickly drops due to the core and sheath effect. Suitable levels of force and temperature at distances of 4–6 inches from the air outlet occur for outlet diameters from 0.570" to 1.062". The air exiting the air outlet 16 may be heated to approximately 140 F to 170 F to result in an air temperature at the user's hands of approximately 135° F. at 4 inches.

FIGS. 8 and 9 depict the variance in both force and temperature of the airstream created by adjusting the dimension of the air outlet. In order to optimize drying, the size of the air outlet should be selected so as to optimize perimeter to area ratio, to be approximately 2.5–7.0. This introduces some entrainment in the sheath region (to increase force) while not entraining so much air in the core region, which would reduce the temperature of the airstream. A range of air outlet dimensions has been developed that provides optimum drying. It is understood that a single, circular air outlet can be replaced by one of different shape such as an ellipse or slot or that two or more air outlets that replicate the single optimized outlet by using the principles of the single outlet may be employed, although with less effectiveness in maintaining the higher flowing air temperature, and producing the desired blow-off force and a perpendicular flow component to break up stagnation layers.

Figure 10:
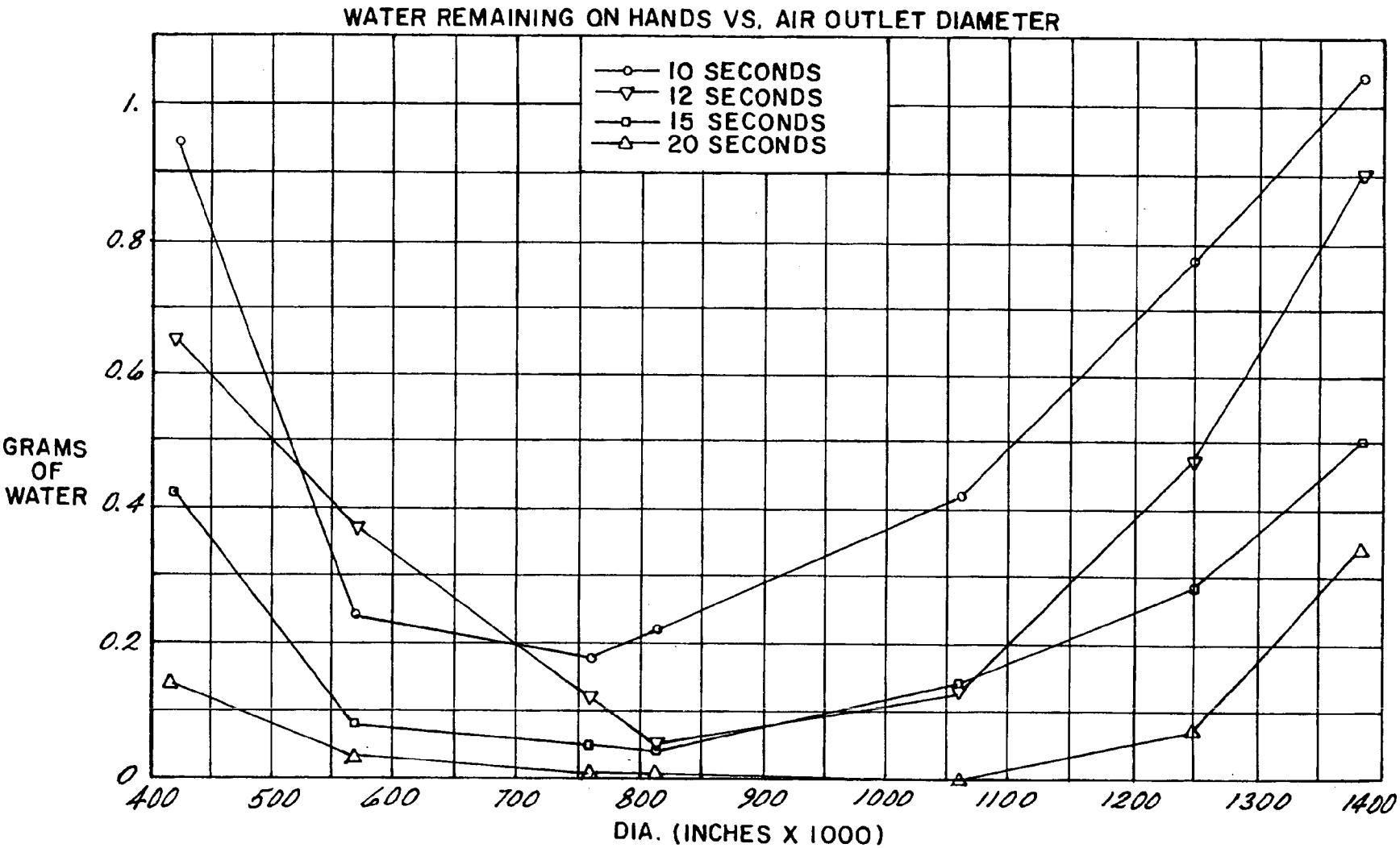
FIG. 10 is a graph of residual water versus air outlet diameter.

FIG. 10 is a graph of grams of water remaining on the hands versus air outlet diameter. A typical test subject was used with average sized hands. The graph contains plots for 10, 12, 15 and 20 seconds of drying time. As shown in FIG. 10, the comfort level of 0.2 grams of residual water can be achieved in a 10–15 second time period using a circular air outlet having a diameter of approximately 0.5 inches to 1.25 inches. Both drying and comfort are attained in ten seconds in this case when the air outlet diameter is in the range 0.7 to 0.8 inches.

Figure 11:
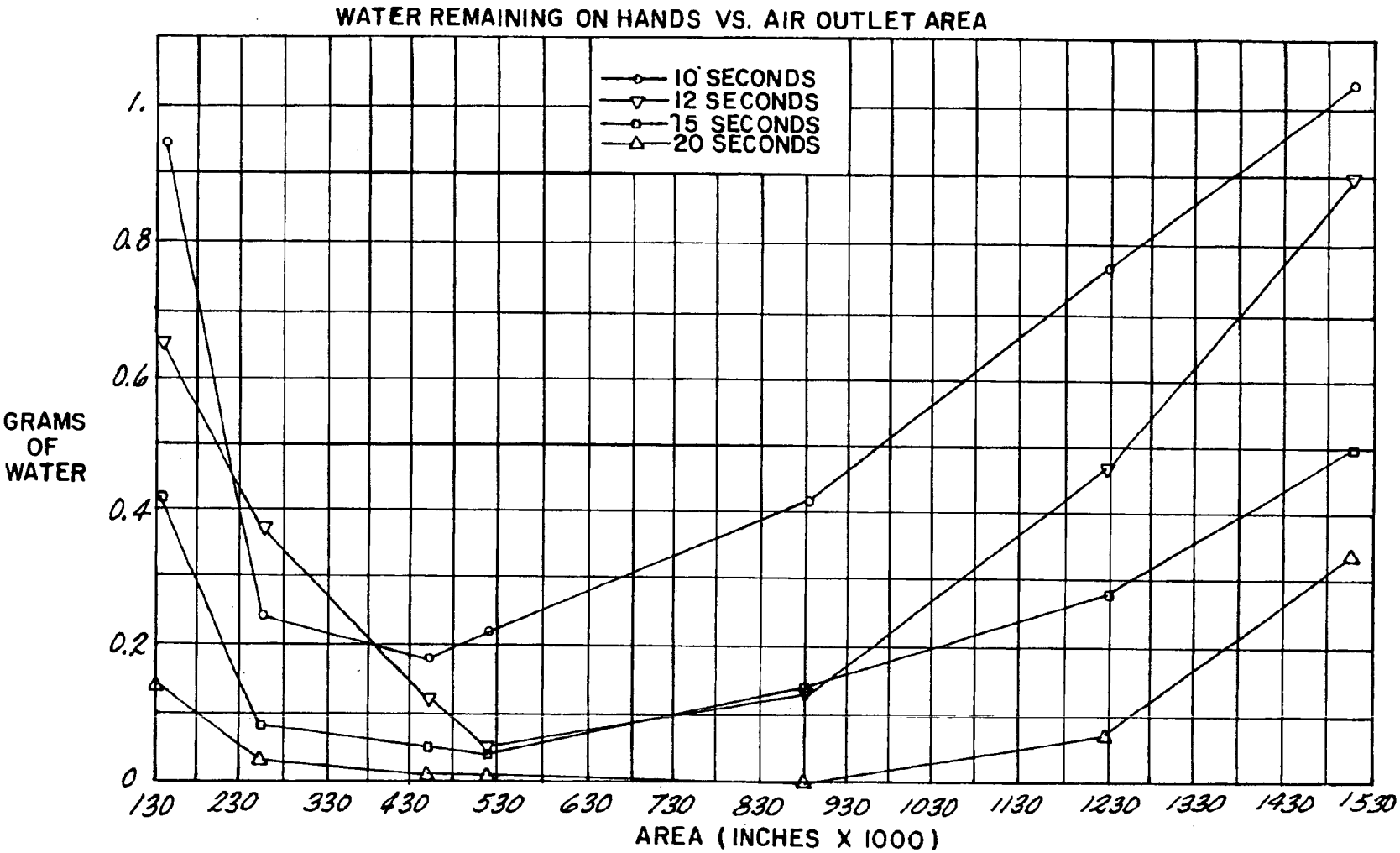
FIG. 11 is a graph of residual water versus air outlet area.

FIG. 11 is similar to FIG. 10 but depicts residual grams of water versus area of the air outlet. Although circular air outlet geometries have been described, it is understood that other geometries may be used including ovals, ellipses, slits, etc. While the advantage of a single circular air outlet has been described in detail, an elongated outlet, or several air outlets would subject the hands to a wider air stream and enhance drying speed, especially for people with large hands. However, as the air outlet becomes too narrow and approaches a slit, the drying process degrades. Entrainment goes up (as it should, since the ratio of perimeter to cross sectional area increases) and core temperature goes down. Accordingly, even when the P/A ratio is not at an optimal value, tradeoffs can be used. For example, for an oval where the minor diameter is half that of the major diameter the shape is still close enough to that of a circle that degrading of the speed of drying is small and such an air outlet shape (and others) can be substituted for the circular shape. The area of the air outlet and the ratio of perimeter to area should be selected to provide some entrainment but not so as to entrain excessive air and reduce the airstream temperature. The air outlets shown in FIGS. 10 and 11 provide a representation of suitable air outlets for achieving reduced drying time and comfort.

The preferred air outlet design is a circular tube, with a length larger than the diameter. The length to diameter ratio can be such as but not limited to 3 to 5 times the diameter or larger, or a ratio that encourages the exiting air column to remain in a relatively non-spreading mode while not significantly impeding air flow. The air entrainment is reduced when the periphery is as small as possible compared to the exiting area, and this corresponds to a circular exit, which is the preferred embodiment. However, other exit shapes can be used with a reduction of temperature and force but the result can still be sufficient to give improved drying performance and reduced drying time.

Referring to FIG. 1, the blower 12 used in the dryer 10 is also selected to provide optimum performance. The, blower 12 is a high volume blower that provides sufficient air momentum force to blast away loose water as well as stagnation barrier layers of air and water molecules on the hands and provides propulsion for high temperature evaporation air. This works because the airstream is made to exit through an air outlet of such dimension and shape as to provide the right amount of outside air entrainment so that a desired high temperature can be attained at the hands while at the same time contributing to force of the airstream.

In an exemplary embodiment, airflow through the air outlet 16 should be no less than 18,000 linear feet per minute (lfm) while maintaining a water column back pressure no less than 30 inches. This means that the motor driving the blower 12 should be a high speed motor having fan blades that rotate at greater than 15,000 rpm. This is an order of magnitude faster than what is used in conventional evaporation hand dryers. A vacuum cleaner motor is an example of a motor that can be used in blower 12 to satisfy this requirement. Multistage blowers will have the higher exit pressure needed. Present blow-off dryers may use such blowers but not in combination with an internal heater or with the range of air outlet sizes and shapes described above. As a result, conventional blow-off dryers do not attain comfort in addition to drying as this invention does.

An exemplary operating point of the blower 12 corresponds to the case where the air outlet 16 area is adjusted so that the product of the exiting airflow volume and the airflow pressure is at or near a maximum. An approximate value for the air outlet area can be determined by selecting the air outlet area so that the back pressure to the blower 12 is about one half of the blank off (maximum) pressure of the blower 12. In an exemplary embodiment, the blank off pressure for the blower 12 was measured at 90 inches. The circular air outlets with diameters of 0.760" and 0.0814" generate back pressures about half this value as shown in FIG. 8.

Figure 14:
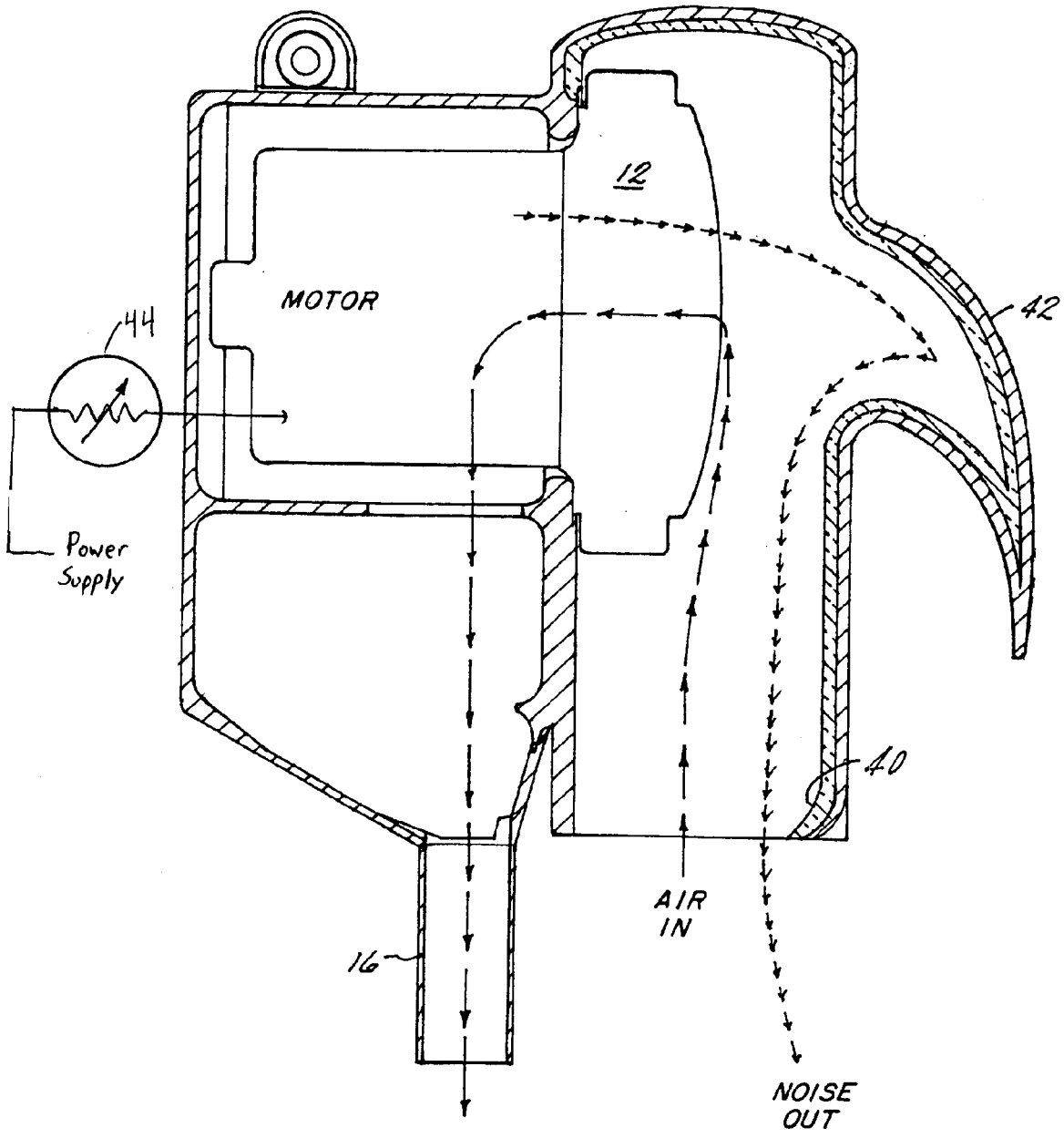
FIG. 14 depicts a cavity structure located at the exit of the air blower to reduce the sound level (dB) in the exiting air.

In order to make the device as quiet as possible, the air outlet, air inlet and motor and blower enclosure are lined with sound absorbing material 40, FIG. 14, suitable for long life survival. In using a rapid flow of air, heated or not heated, to rapidly remove water from the hands, the parameters for the blower should be selected or optimized according to the physics involved. The momentum transferred to the surface water determines the removal of water by the mechanical impact of the air stream on the surface water. The momentum transfer (momentum change) is proportional to the product of the mass flow rate (mass per second and the air velocity (distance per second). The formula for determining force is mass times acceleration (mass * velocity/sec/sec).

The kinetic energy of the airflow is (½)*mass * velocity * velocity. There is more of a benefit from increasing the velocity than in increasing the mass flow. A 10 percent increase in the air velocity is twice as beneficial as a 10 percent increase in the air mass because the kinetic energy increases as the square of the velocity. Increasing the blower rotation speed can increase the velocity of the exiting air. Thus using a blower with a highest rotation speed and/or blower with larger rotator radius can increase the dryer performance. The number of poles and the excitation frequency of the power supply determine rotation speed of a motor. Using a frequency converter to convert the 60/50 Hz power line to a higher frequency drive signal such as but not limited to 440 Hz is one way of increasing the rotation speed. Because of the higher frequency, the coils of the motor must be changed so that the current and power to the motor is not reduced because of the increased reactance of an inductor at higher frequencies.

To increase the frequency of the power driving the motor, the 60/50 Hz line power is converted to higher frequencies by rectifying the ac power to dc, and using the dc to power an oscillator operating at a much higher frequency. Because the dryer motor current can range from 5 amps to about 8 amps, the output oscillator must be a higher power oscillator. The output frequency can be varied, but must be compatible with the inductance of the motor coils.

A switching circuit oscillator is most efficient because the switching transistors only dissipate power during the actual switching on and off because these times are only the times where the product of switch voltage and current is not very low. In the on mode, the current is high but the switch voltage is very low. In the off mode the switch voltage is high but the current is low. The output power is in the form of square waves but this is acceptable to the motor.

Another and more preferable way of increasing the speed of the blower moving the air while using more available motors running on 60/50 Hz is to use gears between the motor and the blower. The gear ratio can increase the blower speed. For a gear ratio of 5:1, a motor speed of 3600 rpm can be increased to 18,000 rpm. Using gears is more cost effective in providing a high-speed motor, and off the shelf motors can be considered. One needs high-speed quiet gears that will last many years but with low duty cycle time.

One way of reducing the cost of the dryer device is to use a high speed brush motor rather than the much more expensive brushless dc motor. Brushless motors have longer lifetime because there are no brushes (usually made of carbon) to wear out. However brushless motors require high power ac excitation at high frequencies, and the associated significant cost of the electronics adds to the cost of the dc, brushless motors.

In an alternate embodiment of the invention, carbon brush motors can be used if the life of the carbon brushes can be increased above the limited life of brush motors. One way is to use longer carbon brushes to partially compensate for the brush wear. The life of brush motors is reduced if the motor is frequently started and stopped. Analysis of the reason for the reduced life suggests that the high current drawn by the brushes at the start can erode the brushes by interface sparks and or transient heating caused by the large starting current. Brush motors that are designed for a fast starting torque have stator field coils in series with the rotor armature and the carbon brushes. Because at the start, when the rotor is not turning, there is no back emf (voltage) produced by the rotor, and the starting current is only limited by the series resistance and inductance of the rotor and stator coils, and can be momentarily large, which can cause additional starting wear on the brushes.

One way of significantly increasing the lifetime of carbon brushes in frequent starting use is to use a current limiter in the current supply. This can be done with an electronic circuit that limits the current, or one that progressively increases the current in a fraction of a second. A preferable and less expensive way is to place a thermistor or surge suppressor in the current supply to the motor, as indicated at 44 in FIG. 14. This thermistor is a resistor that has a resistance that decreases as it is heated by the current flowing through it. The thermal time constant can be such as but not limited to a fraction of a second so that the start of the motor is not noticeably slowed, but the starting current and brush wear is reduced and the motor lifetime is increased. The cost of the control electronics is significantly reduced.

Conventional dryers cannot obtain the reduced drying time and comfort of the present invention for the following reasons. Conventional evaporation dryers have air outlet diameters on the order of 2 inches or more (off scale to the right in FIGS. 10 and 11). As mentioned above, conventional evaporation dryers require 30 to 45 seconds or more to attain a dryness of less than 0.20 grams of residual moisture. Conventional evaporation dryers also typically use a low speed motor. The airstream generated is diffuse and mixes with and is diluted by cool room air. Thus, at distances of 4 to 6 inches from the air outlet exit, where normal hand placement occurs, the average temperature is about 115 degrees F, well below the 135 F attained in this invention, even when a high power internal heater is employed. At the same time, air momentum is so slow as not to entrain enough outside air and thus does not have enough impact energy to destroy the stagnation boundary layer or blow off many water droplets.

Conventional blow-off dryers also cannot obtain the reduced drying time and comfort provided by the present invention. Conventional blow-off dryers use small air outlets, some as small as 0.03" diameter. As noted above, entrainment is so intense that heating the air with an internal heater will raise the temperature of only the portion of the air, namely only that which is emerging from the inside plenum of the dryer. This is such a small proportion of the total air stream (amplifications of air flow of as much as 25 times due to entrainment are common with air knives) that the temperature of the total air stream would be raised a small amount. Since the airstream is not heated, the conventional blow-off dryers lack in-process comfort (i.e. a feeling of warmth during drying) and the user's hands feel cold or clammy immediately after use until the hands warm through the user's circulation.

Figure 12:
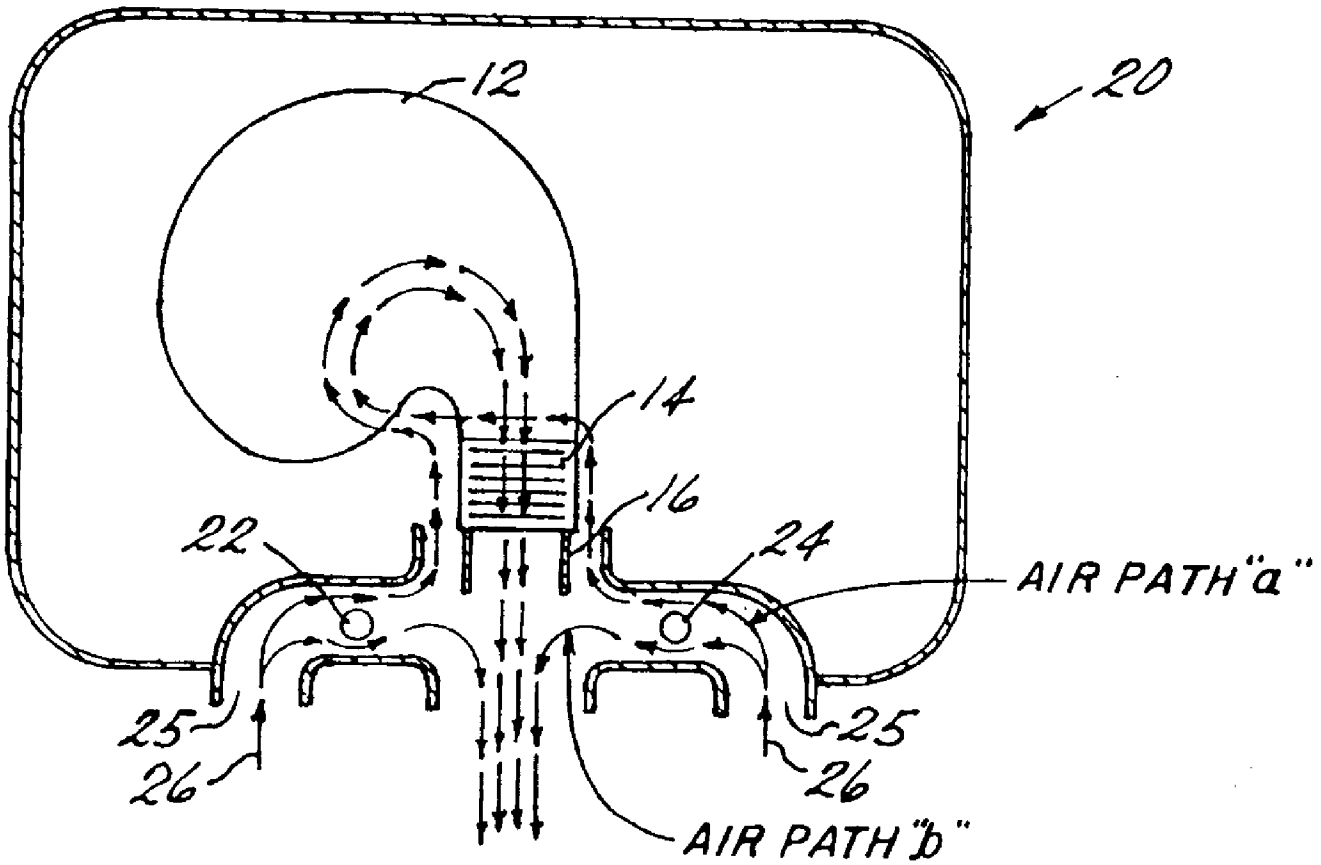
FIG. 12 depicts a dryer in a first alternative embodiment.

FIG. 12 is a diagrammatic view of a first alternate hand dryer shown at 20. Channels 25 are employed to sequester entrained air and direct it through one or more additional heaters 22 and 24. These may be used to heat entrained air 26 that enters the main airstream from the blower 12. The entrained air may divide, some of it merging with the airstream exiting at outlet 16, the remainder merging with the main airstream entering blower 12. In either case, all entrained air is now preheated. Raising the temperature of the entrained air allows the total airstream to reach effective evaporating temperatures thereby meeting the reduced drying time and in-use and post-use comfort goals. Additionally it ensures that all air delivered to the hands, whether entrained or not, has passed through either or both of the high temperature heaters thus destroying bacteria picked up from the ambient air.

Figure 13:
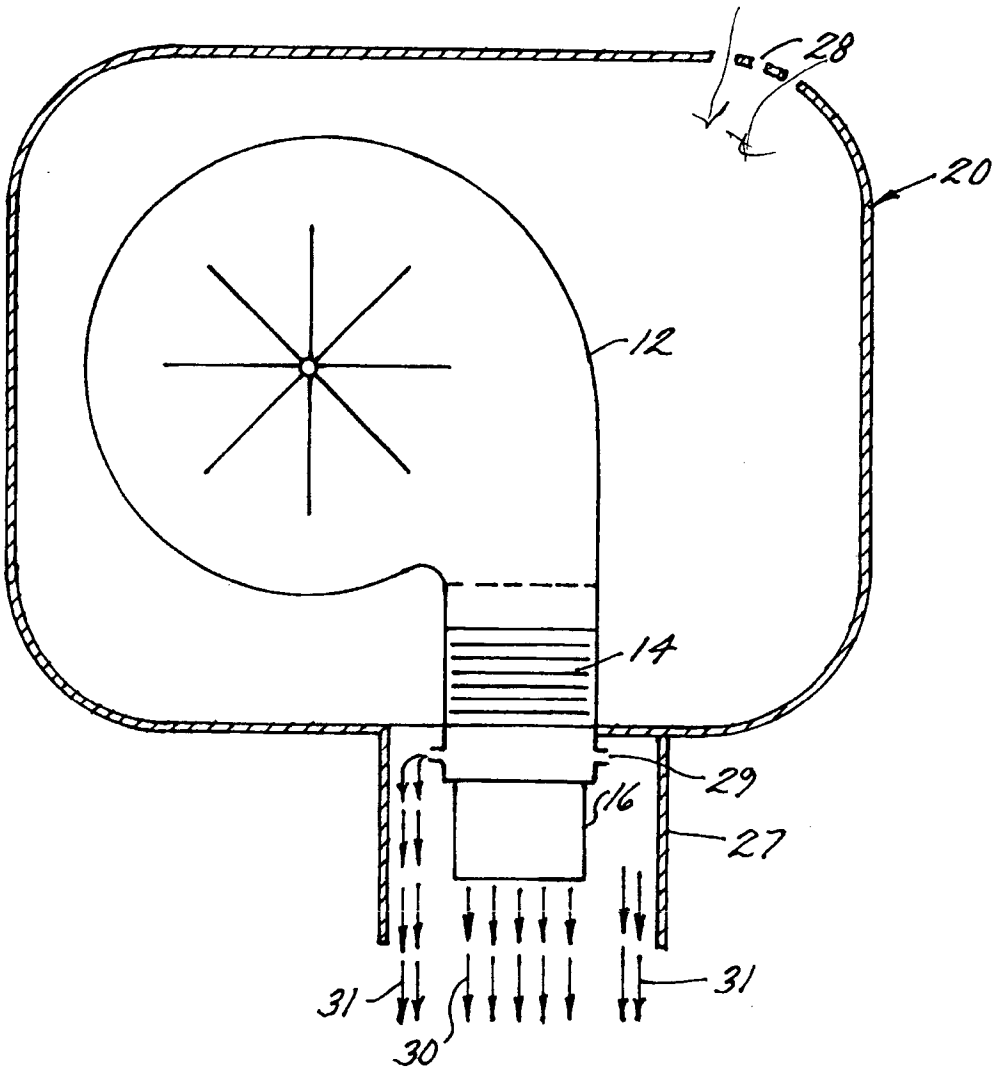
FIG. 13 depicts a dryer in a second alternative embodiment.

FIG. 13 is a diagrammatic view of a second alternate hand dryer which warms entrained air as does the first alternate hand dryer above, but does this by employing a coaxial air outlet structure including an inner outlet 16 surrounded by an outer outlet 27. The embodiment of FIG. 13 differs from FIG. 12 in that all input air enters the fan blower through perforations 28 in outer shell 20 while in FIG. 12 all input air enters through an entrainment path 25. The inner outlet 16 is similar to outlet 16 in FIG. 1. Small perforations 29 just below the heater 14 bleed off a small portion of the airstream, dividing it into two distinct coaxial airstreams. Airstream 30 is a high volume airstream emerging from the inner outlet 16. Airstream 31 is a lower volume, lower pressure airstream and emerges from the outer outlet 27. Since the outer outlet 27 projects about a half-inch lower than the inner outlet 16, and since airstream 31 is moving much more slowly than inner airstream 30, the inner airstream 30 will entrain a portion of the outer airstream 31, rejoining the two airstreams. Since the outer airstream 31 is already warm the entrained sheath will be warmer than that of the exemplary device and will widen the total effective core plus sheath of the air stream and thus the hand area exposed to high temperature. In effect this gives a temperature profile that amounts to a combination of plots E and A in FIG. 4. This improves evaporation without compromising force for blow off and destruction of the stagnation boundary layer. At the same time, since the entrained air is warmed, bacteria in the airstream will decrease as in the first alternate hand dryer described above. In a variation of this embodiment, the perforations 28 can be replaced by a second auxiliary blower rotated by the same motor 12, or a separate blower and motor. This will feed its air into an auxiliary heater from which it proceeds into the top of outer outlet 27.

The high-speed movement of the motor used in the high volume blower 12 air may generate a high sound level (dB). It may be desirable to reduce the sound level (dB) in certain applications. There are two primary and separate sound sources. The first is generated within the dryer and has been determined to emanate from the blower motor, and primarily exiting through sound (pressure pulsations) in the outlet and inlet airflow.

FIG. 14 shows a way of reducing the sound level (dB) in the air exiting the high velocity blower 12. One way of reducing the exiting sound level (dB) is to have the air flow through a duct to the air outlet, with the duct lined with sound absorbing material 40.. Having the air first impact into a cavity 42 lined with sound absorbing material 40 can reduce the sound level (dB). The sound level (dB) will be reduced if the cavity is designed so that the sound reflects off the sound absorbing surfaces 40 of the cavity 42 frequently prior to exiting through air outlet 16. Each reflection off sound absorbing surface 40 absorbs some sound energy.

An alternative to the sound absorbing cavity is an array of sound absorbing projections, with a height of about 0.25 inches high and spaced about ⅓ of the array height. The array is larger than the size of the opening in the blower where the air and sound exit and is located so that the exiting air from the blower impacts the array. The sound will make many collisions with the sound absorbing array of projections, and can be significantly reduced. Vibration absorbing material may be placed in the mountings of the motor to reduce coupling of the vibration of the motor to the dryer housing. In addition, energy absorbing materials may be added to the inside of the hand dryer housing to absorb sound energy vibrations in the air stream and in the dryer housing. This sound deadening material will attenuate the sound rather than reflect it. It may have a memory property (hysteresis), where deformation of the material by sound or vibration will not readily return to the original shape because of the energy converted to heat by the deformation. This material will have temperature stability as required. In addition, labyrinthine muffling baffles, possibly covered with high temperature memory material, may be placed into the air inlet and air outlet paths to further reduce the sound level (dB) without significantly reducing the airflow.

The preferred design involves reducing excess blower power and speed as described above. This reduces blower sound level (dB) and reduces impact sound level (dB). In order to reduce sound level (dB) produced by air impact on the hands while at the same time retaining the fast drying time, blower speed is to be reduced to just above the level at which drying effectiveness is degraded. Any motor speed above that level does not aid drying speed but does increase sound level (dB). The time period of maximum hand impact (the 2 to 3 second blow off period) can be reduced by electronic programming of motor speed as described above.

As a final stage in dryer assembly, taking advantage of nulls that may occur as a function of small variations in blower speed when certain sound level (dB) generation effects tend to cancel each other out can lower any remaining blower sound level (dB). The assembler can fine-tune the final speed, using an acoustic meter as guide, to set the final product at its best null. Although tuning for nulls may reduce sound level (dB), the recommended approach is to reduce the output sound level (dB) sufficiently so that tuning for a null is not needed.

The second source of sound level (dB), impact on the hands, is highest when the angle of impact is normal or 90 degrees. When the air outlet is tilted toward the wall, a component of the air stream skims off the loose water effectively (rather than "blasting" it off). FIG. 1 shows the air outlet 16 angled towards a rear wall 11 of the dryer housing. The rear wall 11 of the dryer housing is mounted to a wall 7. The lower the angle, the more the skimming and the less the impacting (blasting). Thus, the smaller the impact angle, the less the sound level (dB). The shallowness of the angle has to be a compromise; if it is too small, the user cannot get his hands under the air outlet. When the air outlet is tilted, it will be in the direction of the wall so as not to blow water on the user. Another way to decrease the angle is to position closer to the floor. This causes a user of average height automatically to tilt his hands so that the impact angle is shallower.

Angling the direction of the exit nozzle and the air flow slightly towards the wall has the additional advantage that the water droplets blown of the hands are directed towards the wall rather than toward the feet or clothing of the person using the dryer.

It is preferable, but not required, that the hand dryer operate using 15 amps or less. By selecting an appropriate high-speed motor for the blower, ampere drain at 110 volts will not exceed 4 amperes. For a 15-ampere line this leaves 11 amperes for the heater 14 or for a heater/infrared bulb combination. It may be possible to use a motor that requires as much as 10 amperes. If such a motor is used, then this embodiment of the invention may use a current controller to control distribution of current between the blower 12 and the heater 14. An exemplary current controller may be implemented using PLA or microprocessor technology. During the blow-off phase, the current controller directs all or substantially all current to the blower to achieve maximum blow-off. A small amount of current may be directed to the heater for preheating. During transition from the blow-off phase to the evaporation phase, current is transferred from the blower 12 to the heater 14 based on a predetermined function. In the latter stages of the evaporation phase, fast moving air is not critical and substantially all current is directed to the heater 14 while the blower 12 runs at reduced speed and amperage.

As described above, the heater 14 may include an infrared heat source. An infrared heat source provides heat to the user's hands resulting in increased comfort. It may also provide additional benefits such as killing bacteria in and around the dryer housing. Another benefit is that the visible light emitted by an infrared source will illuminate the hands and may be used to guide the user to best placement for his hands for optimum drying rate. Additionally, an ultra-violet light may be used to reduce bacteria and/or viruses. Air inlet can be from the side rather than from the bottom in order to reduce air entrainment of bacteria on the wall below the dryer.

While the above-described invention relates to a hand dryer, one skilled in the art will recognize that the present invention may be used to dry any number of surfaces, such as one's hair, arms and body. It may also be utilized to dry objects such as but not limited to food items or machine parts, as they are presented in a conveyor belt or other such means.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An apparatus for driving hands, comprising:

a blower for generating an air jet,
where is blower is driving by an electric motor, and
a heater for increasing temperature of said air jet, and an air outlet for outputting said air jet, where said air jet flow is no less than 18,000 linear feet per minute, wherein:
where said dryer is mounted on the wall, and said air jet is angled towards the wall so that said water blown off is blown away from the user.

2. An apparatus for drying hands, comprising:

a blower for generating an air jet,
where the blower is driven by an electric motor, and a heater for increasing temperature of said air jet, and an air outlet having a longitudinal axis, the air outlet outputting said airjet, and,
where said outlet is tubular with an open end for said air jet to exit along the longitudinal axis, and
where said air outlet is circular, and
where said air outlet has a diameter between 0.5 inches to 1.25 inches, and
where said air outlet has a length 3 to 5 times as large as said air outlet diameter, and
where said air jet flow is no less than 18,000 linear feet per minute, and
where said air jet at said air outlet has a pressure force of about 50 inches of water pressure height at said outlet, and has 20 inches of water pressure height at a distance of 6 inches from said air outlet, and
where said air jet is heated, and is at a temperature of approximately 135 deg. F at 4 inches from said air outlet, and a sound absorbing portion including an array of sound absorbing projections, said projections having a height of about 0.25 inches and spaced apart by ⅓ of the height, and whereby said airjet blows off at least 75% of the water from said hands in less than 3 seconds, and whereby said airjet breaks up a stagnation boundary layer on said hands and aids in evaporation of remaining water, and whereby said hands are dried in less than 15 seconds, and whereby when dried, said hands have less 0.3 grams of water remaining on said hands, and whereby immediately after drying, said hands do not cool due to evaporation of remaining water.

3. The apparatus of claim 2 where the blower is a two stage blower.

4. An apparatus for drying hands, comprising:

a blower for generating an airjet,
where the blower is driven by an electric motor, and a heater for increasing temperature of said air jet, and an air outlet having a longitudinal axis, the air outlet outputting said airjet, and,
where said outlet is tubular with an open end for said airjet to exit along the longitudinal axis, and
where said air outlet is circular, and
where said air outlet has a diameter between 0.5 inches to 1.25 inches, and
where said air outlet has a length 3 to 5 times a large as aid air outlet diameter, and
where said air jet flow is no less than 18,000 linear feet per minute, and
where said air jet at said air outlet has a pressure of about 50 inches of water pressure height at said outlet, and has 20 inches of water pressure height at a distance of 6 inches from said air outlet, and
where said air jet is heated, and is at a temperature of approximately 135 deg. F at 4 inches from said air outlet, and
where said dryer is mounted on the wall, and said air jet is angled towards the wall so that said water blown off is blown away from the user, and whereby said airjet blows off at least 75% of the water from said hands in less than 3 seconds, and whereby said air jet breaks up a stagnation boundary layer on said hands and aids in evaporation of remaining water, and whereby said hands are dried In less than 15 seconds, and whereby when dried, said hands have less than 0.3 grams of water remaining on said hands, and whereby immediately after drying, said hands do not cool due to evaporation of remaining water.

5. The apparatus of claim 4 where the blower is a two stage blower.

6. An apparatus for drying hands, comprising:

a blower for generating an air jet, where the blower is driven by an electric motor, and where said motor is a brush type motor with a themistor resistor in series with the bmshes to limit the starting current in order to extend said brush life, and a heater for increasing temperature of said airjet, and an air outlet having a longitudinal axis, the air outlet outputting said air jet, and, where said outlet is tubular with an open end for said air jet to exit along the longitudinal axis, and where said air outlet is circular, and where said air outlet has a diameter between 0.5 inches to 1.25 inches, and where said air outlet has a length 3 to 5 times as large as said air outlet diameter, and where said air jet flow is no less than 18,000 linear feet per minute, and where said air jet at said air outlet has a pressure force of about 50 inches of water pressure height at said outlet, and has 20 inches of water pressure height at a distance of 6 inches from said air outlet, and where said air jet is heated, and is at a temperature of proximately 135 deg. F at 4 inches from said air outlet, and where said dryer is mounted on the wall, and said airjet is angled towards the wall so that said water blown off is blown away from the user, and a sound absorbing portion including an array of sound absorbing projections, said projections having a height of about 0.25 inches and spaced apart by ⅓ of the height, whereby said airjet blows off at least 75% of the water from said hands in less than 3 seconds, and whereby said airjet breaks up a stagnation boundary layer on said hands and aids in evaporation the remaining water, and whereby said hands are dried in less than 15 seconds, and whereby when dried, said hands have less than 0.3 grams of water remaining said hands, and whereby immediately after drying, said bands do not cool due to evaporation of remaining water.

7. The apparatus of claim 6 where the blower is a two stage blower.

* * * * *